US006644080B2

(12) United States Patent
Lindstrom

(10) Patent No.: US 6,644,080 B2
(45) Date of Patent: Nov. 11, 2003

(54) PRESS BRAKE WORKSHEET POSITIONING SYSTEM

(75) Inventor: Mikko Lindstrom, South Barrington, IL (US)

(73) Assignee: Finn-Power International, Inc., Arlington Heights, IL (US)

( * ) Notice: Subject to any disclaimer, the term of this patent is extended or adjusted under 35 U.S.C. 154(b) by 345 days.

(21) Appl. No.: 09/758,337

(22) Filed: Jan. 12, 2001

(65) Prior Publication Data

US 2002/0092333 A1 Jul. 18, 2002

(51) Int. Cl.[7] ..... B21D 11/22; B21D 43/11; B21C 51/00

(52) U.S. Cl. ..... 72/19.4; 72/37; 72/420; 72/389.6

(58) Field of Search ..... 72/19.4, 37, 420, 72/421, 422, 389.6

(56) References Cited

U.S. PATENT DOCUMENTS 4,399,675 A * 8/1983 Erdmann et al. ..... 72/37
4,564,765 A * 1/1986 Blaich ..... 72/37
4,706,491 A * 11/1987 Sartorio ..... 72/461
4,772,801 A 9/1988 Fornerod et al.
5,182,936 A * 2/1993 Sartorio ..... 72/420
5,187,958 A * 2/1993 Prunotto et al. ..... 72/420
5,488,470 A 1/1996 Ooenoki
5,531,087 A * 7/1996 Kitabayashi et al. ..... 72/37
5,608,847 A 3/1997 Pryor
5,661,671 A 8/1997 Ooenoki et al.
5,761,940 A * 6/1998 Moore et al. ..... 72/420
5,865,056 A 2/1999 Nagakura
5,899,964 A 5/1999 Ooenoki et al.
5,987,958 A 11/1999 Moore, Jr. et al.
6,389,860 B1 * 5/2002 Stalzer ..... 72/389.6

* cited by examiner

*Primary Examiner*—David B. Jones
(74) *Attorney, Agent, or Firm*—Louis Woo

(57) ABSTRACT

To improve the speed with which a worksheet is positioned in a press brake, and to further eliminate the need for conventional moving back gauge systems, the present invention replaces the conventional back gauge mechanical system with sensors that non-contactedly determine the positioning of the worksheet, with reference to the bending tools. The thus sensed worksheet position is compared with the desired worksheet location preprogrammed into the CNC controller. Any deviation between the sensed, or the actual worksheet position, with the desired worksheet position for each bend of the worksheet is compensated by further moving the worksheet, until there no longer is any discrepancy between the actual and the preprogrammed desired locations.

20 Claims, 8 Drawing Sheets

20

PRESS BRAKE WORKSHEET POSITIONING SYSTEM

FIELD OF THE INVENTION

The present invention is directed to sheet fabrication machines and more particularly to a press brake with an improved sheet positioning system.

BACKGROUND OF THE INVENTION

A typical press brake has a lower tool, typically referred to as a V tool or a die, and an upper tool that acts as a punch that mates with the lower tool. To bend a workpiece placed between the upper and lower tools, the lower tool may remain stationary while the upper tool acts thereagainst. Conversely, the upper tool may stay stationary while the lower tool would move up to act against a worksheet. These up and down motions by the upper and lower tools of the press brake are accomplished by using a number of known drive mechanisms, including for example a hydraulic drive by using one or more hydraulic cylinders, or a mechanical drive that utilizes a combination clutch and brake fly wheel system.

To bend a worksheet correctly, the worksheet has to be positioned to the correct position for each of the bends. Conventionally, positioning is determined by programmable stops, otherwise known in the art as back gauge "fingers". These "fingers" are force sensors that are mounted to back gauges to the back of the press brake which are positioned some distance from the center of the upper and lower tools or punches. The positioning of the back gauges is automatic and is controlled by a CNC controller sending commands to a servo system. Servo systems that are used in the sheet fabricating art for driving the back gauges include Cyberlec, Siemens, Hurco and Automec, among others. The typical back gauge system has two back gauge fingers that are movable along an axis that is perpendicular to the direction along which the punch and die move. This axis is conventionally referred to as the X axis. The programmable fingers also are movable along a vertical axis, commonly referred to as the R axis. The back gauge fingers can also move either in a pair-wise fashion or independently, in which case there are independent X and R axes for each of the back gauge fingers. Independent back gauge fingers are used for those complicated bending operations that involve positioning references for different bends and/or a part that may have to be taken from two different heights or depths with reference to the center of the upper and lower tools along the X axis.

The various bending operations for effecting different bends to a worksheet are conventionally programmed into the CNC controller. The back gauges are used to ensure that the positioning of the worksheet for each bend is correct. To achieve this, an edge of the worksheet is pressed against the back gauge fingers, as the upper punch and the lower die would come together to effect the bend. After each bend the back gauge fingers would move to a new position in anticipation of the worksheet pressing against the fingers. This cycle of moving of the back gauges, the positioning of the worksheet and the pressing of the worksheet against the back gauge fingers is repeated for each bend of the worksheet.

The pressing of the worksheet of the to be fabricated part against the back gauge fingers is acceptable so long as the machine is either being operated by a human operator or is operating at a slow speed. However, for a press brake where the part positioning is being done by a robot, and if it is the pressing action on the back gauge fingers that is used to activate a switch or a pair of switches to indicate the correct location of the worksheet for bending, such conventional pressing of the back gauge finger sensors would act to slow down the bending operation. Moreover, given that the back gauges are driven by multiple servomotors, and their associated motion systems that may include bore screws, belts or linear gear systems for each axis of movement, physical deterioration of the drive system for the back gauges occurs. As a consequence, the positioning of the parts to be bent may not be as accurate as it should be. Accordingly, the bends on those parts may end up being out of tolerance.

BRIEF DESCRIPTION OF THE PRESENT INVENTION

To ensure accurate positioning of a worksheet or part for every bend in a press brake, and furthermore without having to worry about the back gauge system becoming inaccurate and/or breaking down, the present invention provides a contactless gauge system that can accurately ascertain the correct positioning of the worksheet for each bend of the worksheet and for compensating any deviation in the positioning of the worksheet.

Specifically, in place of a mechanical back gauge system, the present invention comprises an optical system that utilizes a laser system, an imaging system, and/or a combination of both. In one of the embodiments, a laser system is placed at a certain distance relative to the upper and lower tools at the backside of the press brake. By means of the non-contact sensors that work in conjunction of the output laser beams, the actual position of the workpiece could be determined. Once determined, the actual measured position of the worksheet is compared with the preprogrammed position of the worksheet for the particular bend. And if the desired programmable position matches that of the actual measured position, then the bending of the worksheet could proceed. This process of actually moving the worksheet, the sensing of the actual position of the worksheet, and the comparing of the actual position with the sensed position is repeated for each bend of the worksheet. If there happens to be a deviation between the programmed position and the measured position of the worksheet, then a further movement of the worksheet is made to move the worksheet to the programmed position before the bending of the worksheet commences.

Another embodiment of the present inventive non-contact measurement of the position of the worksheet could be effected by a camera monitoring system in which a view of the backside of the upper and lower tools of the press brake is taken. This image includes the end edge of the workpiece. The image is divided into appropriate coordinates so that a precise location of the end edge of the worksheet is measured. The measured edge of the worksheet is then compared with a stored image of what that end edge should be at if the worksheet were correctly positioned. If a comparison of the programmed image and the scanned image of the position of the worksheet matches, then the bending of the worksheet could commence. If not, additional movement of the worksheet is effected; and another image is taken after the additional movement of the worksheet so that yet another comparison is made between the measured image and the preprogrammed image to determine if further compensation or movement of the worksheet is required.

Yet another embodiment of the present invention involves the use of a combination of laser and imaging systems. In this embodiment, a number of laser beams are directed to the backside of the press brake so as to intersect the back edge of the worksheet. A monitoring camera then senses the multiple points at the edge of the worksheet intersected by the plurality of the laser beams. From these multiple intersected points, the CNC controller can calculate, by for example a triangulation method, the actual position of the worksheet. And by comparing the measured position with the preprogrammed position, any deviation to the positioning of the worksheet that occurs could be readily compensated, before actual bending of the worksheet takes place.

The inventor of the present invention further envisions a simple system that could be retrofitted readily to an existing back gauge system that nonetheless provides for contactless determination of the actual positioning of the worksheet. This is done in yet another embodiment of the instant invention in which sensors that could determine from a given distance the arrival or existence of a part are incorporated to the exiting back gauges of a press brake. This is done by replacing the conventional finger sensors with non-contact sensors, which could be sensors that work by determining the electromagnetic flux near it or laser sensors that could determine the edge of the worksheet at a predetermined distance. Thus, by utilizing the existing servomotors to drive the back gauges in a shadow movement to the movement of the worksheet at a given distance, the back gauges of such retrofitted sensing system would never come into physical contact with the edge of the worksheet insofar as the back gauges would always be at a safe distance from the edge of the worksheet. Any over movement on the part of the worksheet would cause a corresponding backward movement by the back gauge. The fact that the sensors mounted to the back gauge fail to detect the edge of the worksheet or that the back gauges in fact move further then they should after the CNC controller has terminated its movement of the worksheet means that there is a deviation, and the requisite compensation movement of the worksheet is then taken.

It is therefore an objective of the present invention to provide a system that can monitor without contact the precise location of a worksheet relative to the upper and lower tools of a press brake.

It is another objective of the present invention to provide a contactless worksheet gauge system that obviates the need for any moving system that would cause inaccuracy due to the wear and tear of the mechanical components over time.

It is yet another objective of the present invention to provide a contactless worksheet gauge system that enhances the operation of determining the precise location of a worksheet since the movement of the worksheet no longer has to slow down to make contact with any back gauge fingers.

It is still another objective of the present invention to provide a contactless worksheet position gauging system that can be retrofitted to an existing back gauge system of a press brake.

BRIEF DESCRIPTION OF THE FIGURES

The above-mentioned objectives and advantages of the present invention will become more apparent and the invention itself will be best understood by reference to the following description of embodiments of the invention taken in conjunction with the accompanying drawings, wherein.

DETAILED DESCRIPTION OF THE PRESENT INVENTION

Figure 1:
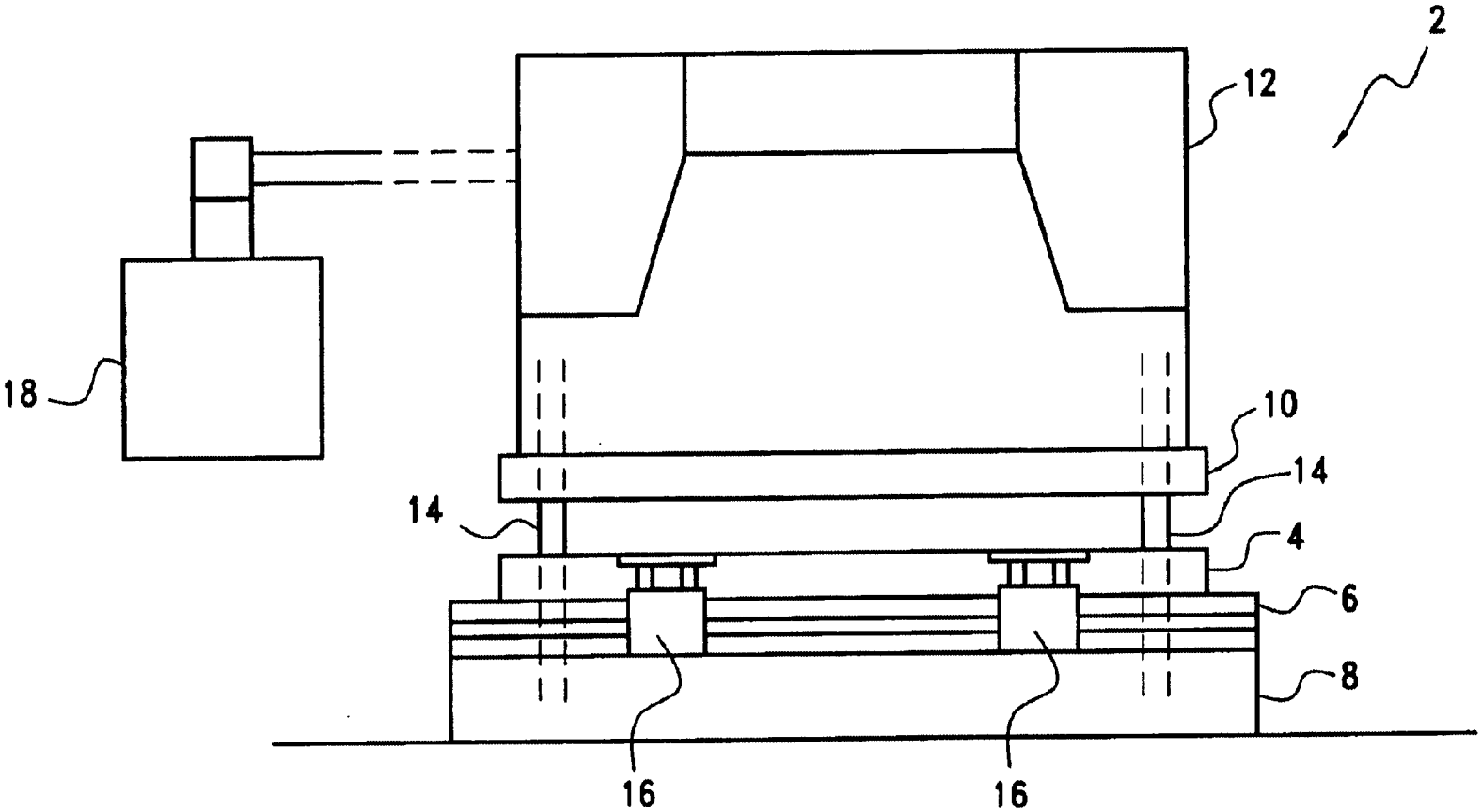
FIG.1 PRIOR ART
FIG. 1 is a plan view of a conventional press brake.

With reference to FIG. 1, a press brake 2 is shown to comprise a lower tool die 4 placed along a die rail 6 on a base 8. Lower tool 4 is a V die which mates with an upper tool punch 10 that is mounted to an upper frame 12. Upper tool 10 is moved vertically to mate with lower tool 4 by drive mechanisms (not shown) that may be mechanical or hydraulic in nature. So, too, lower tool 4 could be driven by mechanical or hydraulic drive mechanisms to press up against upper tool 10. Back frames 14 provide support for press brake 2.

As further shown, in front of rail 6 two supports 16 are movably mounted. Supports 16 provide a rest stop for the front edge of a worksheet positioned into the opening between upper tool 10 and lower tool 4 for bending.

To control the relative movement of upper tool 10 and lower tool 4, electrically connected to press brake 2 is a conventional CNC controller such as for example a DNC 800 controller by the Cybelec S.A. of Switzerland. In fact, press brake 2 as shown in FIG. 1 is exemplified by the FPB press brake of the Finn-Power Company.

Figure 2:
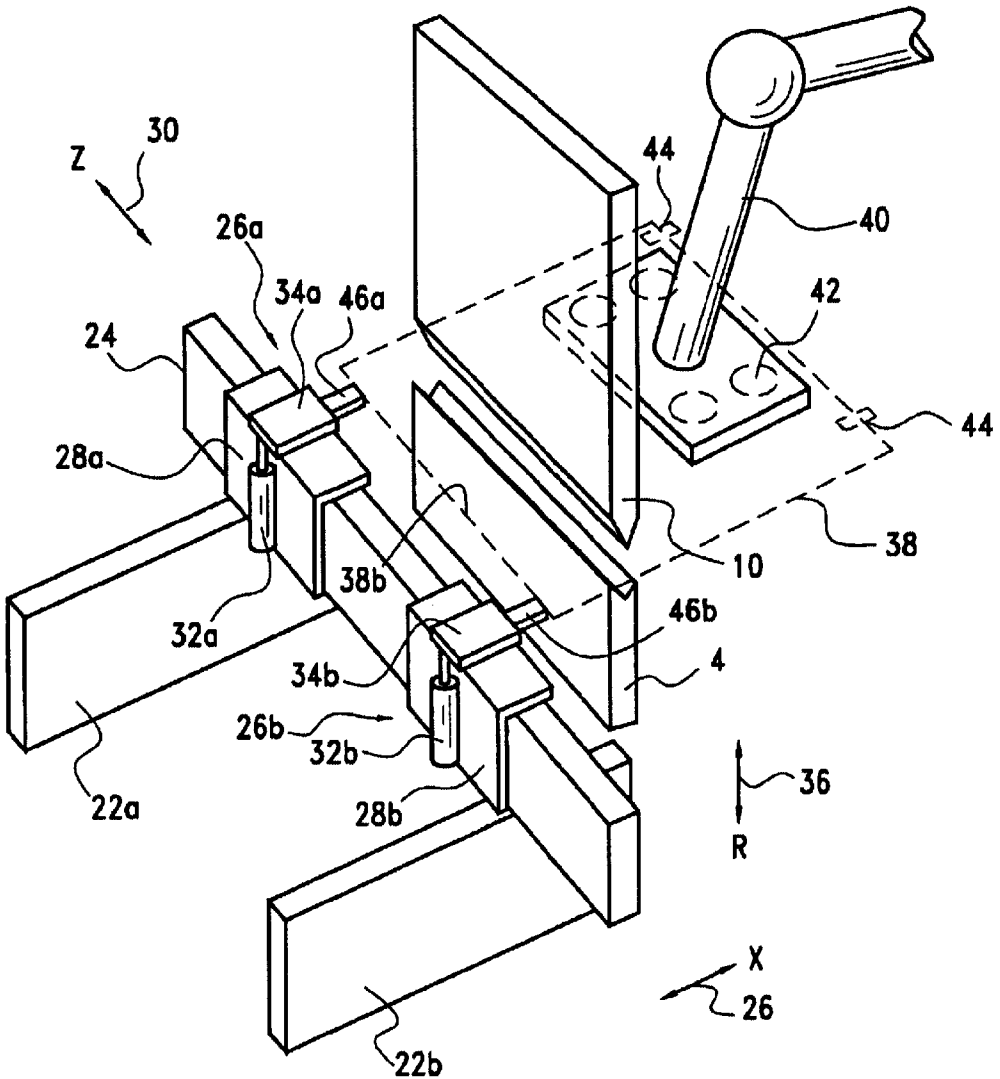
FIG. 2 is a perspective view of the essential components of a press brake with a back gauge system.

With reference to FIG. 2, a simplified perspective view of the backside of a press brake is shown. Taking away all of the components that are not necessary for the understanding of this invention, note that to the back of upper tool 10 and lower punch 4 is a back gauge assembly 20 which comprises two support rails 22*a* and 22*b*. A cross beam 24 is movably mounted on rails 22*a* and 22*b*, and accordingly is movable in the direction as indicated by directional arrow 26. Mounted to cross beam, or cross carriage 24, are a plurality of back gauge devices 26*a* and 26*b*. Each of the back gauge devices 26 is made up of a mounting frame 28 that is movable along the direction as indicated by directional arrow 30. In addition, fixed to the respective mounting frames 28 are driving cylinders 32*a* and 32*b*. These cylinders are used to drive back gauge mounts 34*a* and 34*b*, respectively, so that back gauge mounts 34 can move along a direction as indicated by directional arrow 36, which otherwise is referenced in the art as being the R direction. Thus, each of back gauges 34 can move in three directions with reference to upper and lower tool 10 and 4, and in particular with respect to a hypothetical plane that separates upper tool 10 from lower tool 4. This hypothetical plane, as shown in FIG. 2, is represented by a worksheet 38 placed between upper tool 10 and lower tool 4.

Worksheet 38 is gripped and moved by a gripping device, which may be a robot, represented by robot arm 40. Appropriate joints (not shown) are built into the robot so that arm 40 may move in any direction, as for example the X, Z and R axes represented by the directional arrows 26, 30 and 36. To hold worksheet 38, a plurality of suction cups, represented by dotted lines 42, are used. Such robots may be used with the aforementioned Finn-Power FPB press brakes. Alternatively, in place of a robot, a conventional set of grippers 44, such as for example those used in the system disclosed in U.S. Pat. No. 4,658,682, may be used. The disclosure of the '682 U.S. patent is incorporated by reference herein.

In a conventional press brake, such as for example the above-mentioned Finn-Power FPB press brake. Mounted to each of back gauges 34 is a force sensor 46 that is activated when the edge 38*b* of worksheet 38 comes into contact therewith. If worksheet 38 were to be moved too quickly by the robot gripping device 40, edge 38*b* would come into contact with sensors 46 at a great force, thereby possibly causing damage to sensors 46. Consequently, in the programming of the movement of worksheet 38, or any other part being moved by a gripper device for bending by upper tool 10 and lower tool 4 of the press brake, the movement of worksheet 38 is substantially slowed at the latter part thereof when the worksheet is approaching its predestined location where the back gauges are, so that by the time the worksheet reaches sensors 46, only the force that is necessary to activate those sensors would come into contact with sensors 46.

Sensors 46, in turn are connected electrically to the CNC controller 18, so that once contacted with edge 38*b* of worksheet 38, those sensors would send a feedback signal to CNC controller 18 to inform the controller that indeed worksheet 38 has been positioned correctly. Of course, the respective movements of worksheet 38 for the various bends to be effected thereon had previously been programmed into CNC controller 18. In the same vein, the movements of back gauges 46 have been calculated in conjunction with the respective movements of worksheet 38 so as to be theoretically in sync with the respective movements with worksheet 38, so that sensors 46 of the back gauge assembly could provide a positive feedback to controller 18 to indicate that indeed worksheet 38 has been positioned correctly for each of the bends.

The fact that a physical contact has to be made between worksheet 38 and sensors 46 means that, as was mentioned previously, the movement of worksheet 38 by the gripper mechanism, such as for example robot 40, has to slow down at the end of each of the movements. Otherwise, the sensors could be damaged by the contact force from the worksheet. In addition, given that the movement of sensors 46 are dependent on a number of servomotors for driving cross-beam 24, back gauge mounts 28 and back gauges 34 along the various directions means that there needs to be a great deal of upkeep for those moving systems, both in terms of the accuracy of the movement and the respective alignments of those parts relative to each other, and to upper and lower bending tools 10, 4. As was mentioned before, any collision by worksheet 38 with sensor 46, which may also be referred to as the back gauge "fingers", would be catastrophic and expensive, both in terms of down time and the need to repair or replace the back gauge sensors.

The instant invention eliminates the need for any mechanical moving back gauge assembly and the need for controller 18 to slow down the latter stage movement of the part that is being bent. This is achieved by the utilization of a contactless back gauge system, a first embodiment of which is shown in FIG. 3.

As illustrated, in place of a mechanical back gauge assembly, a plurality of laser systems such as for example the Copra Laser Check System made by the Data M Engineering GmbH of Oberlaindern, Germany are provided to the back of the bending tools 10, 4. The usage of such laser system, prior to the instant invention, is focused to detecting the bending angle of a part being bent by a press brake. The calculation of the bending angle and the use of such laser device therefor is disclosed, for example, in U.S. Pat. No. 4,772,801, the disclosure of which is incorporated by reference herein.

In particular for the instant invention, laser systems 48 and 50 are positioned such that each will detect the edge of worksheet 38 with reference to upper and lower tools 10, 4. Each of the laser systems comprises a semiconductor laser with line optics and a ⅓ inch CCD camera that enables an exact evaluation of the edge 38*a* with reference to the plane along which upper tool 10 and lower tool 4 lies. The thus measured position of worksheet 38, and particularly edge 38*a* thereof, is compared with the desired position of worksheet 38 as preprogrammed and input to CNC controller 18 before the bending operation of worksheet 38. If there is a deviation between the actual positioning of worksheet 38 by gripper mechanism 40, when compared with the programmed position for that particular bend of worksheet 38, then controller 18 would send a compensation signal to gripper mechanism 40 to further move worksheet 38 to correct or compensate the deviation. Thereafter, worksheet 38 is bent by upper and lower tools 10, 4. After that bend, and after the separation of upper tool 10 from lower tool 4, worksheet 38 is further moved by gripper arm 40 to a new position for the next preprogrammed bend. The same process for sensing the actual position of worksheet 38 and comparing that position with the desired position for that bend is repeated until all bends have taken place for that particular part or worksheet 38.

Figure 3:
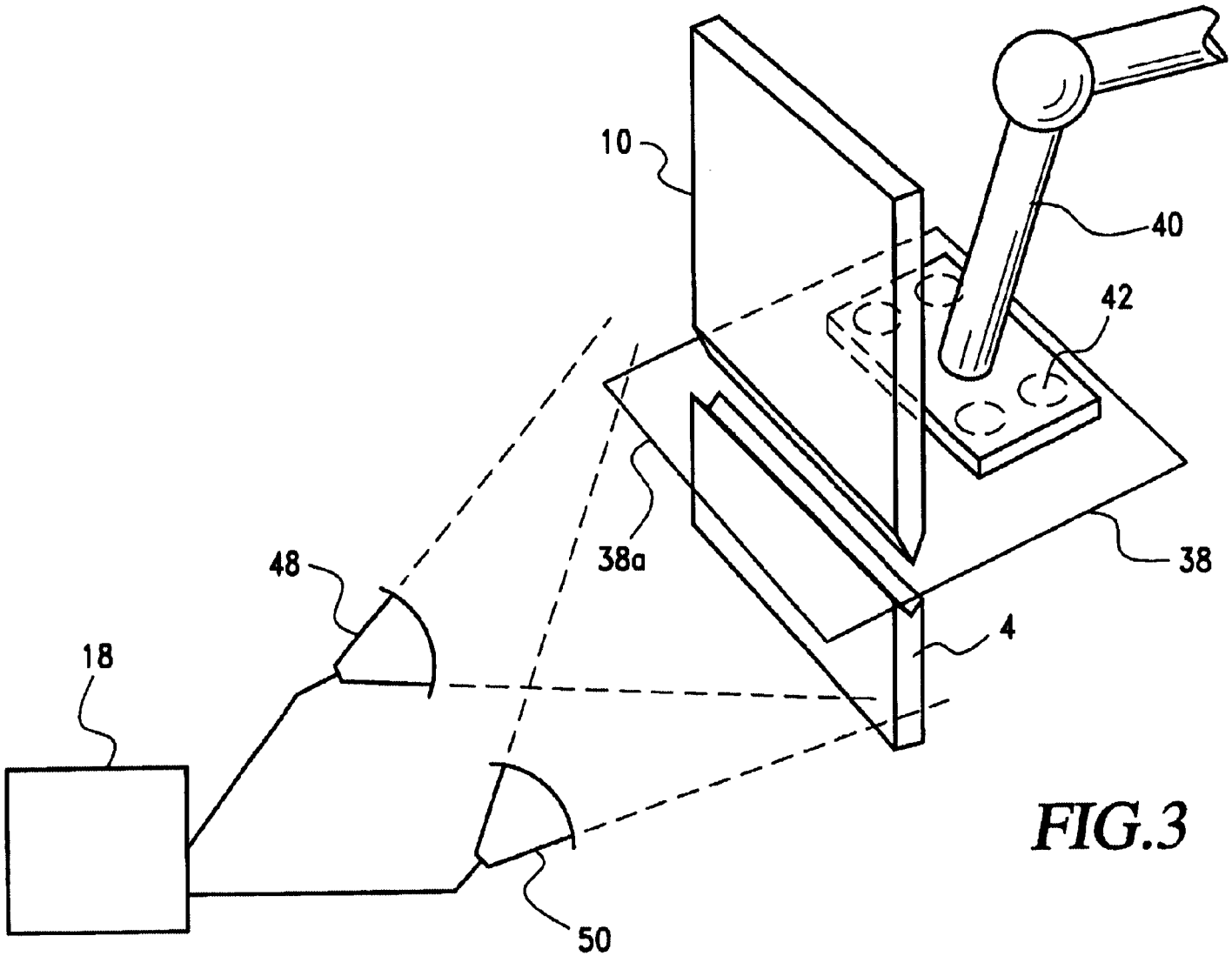
FIG. 3 is an illustration of a first embodiment of the contactless back gauge system of the present invention.

Even though two laser systems are shown in the FIG. 3 embodiment, it should be appreciated that in actuality, there only needs to be one laser system, so long as that laser system is able to view the entire length of edge 38*a*, with reference to bending tools 10, 4. On the other hand, if the press brake is a large system, a plurality of interconnected laser systems with a number equaled to or greater than two may also be used, in order to cover the entire bending area of the press brake. The operation of the laser system, and the method in which an edge of a worksheet may be calculated with respect to a reference, could be gleaned from the aforenoted incorporated by referenced '801 patent.

Figure 4:
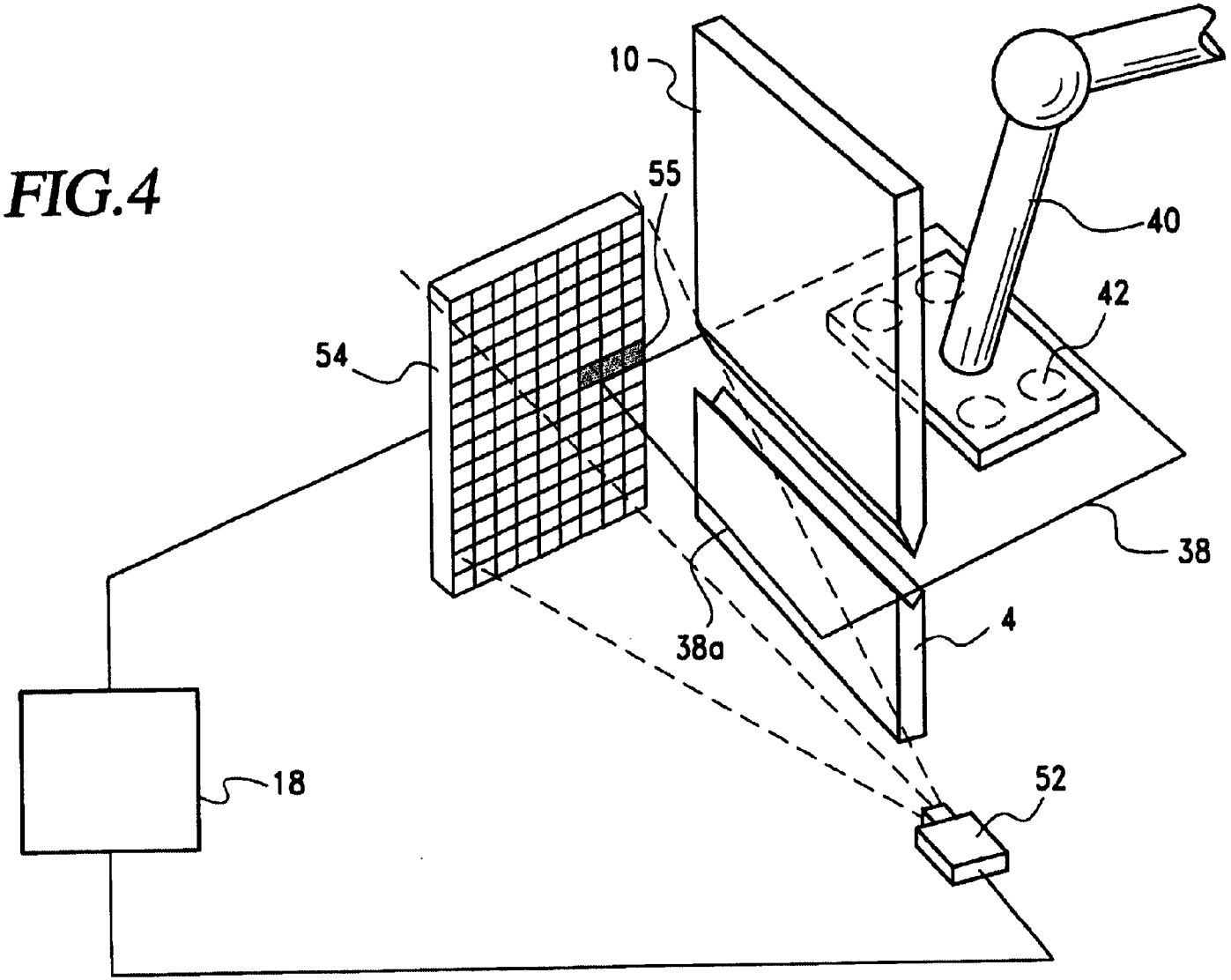
FIG. 4 is another embodiment of the contactless back gauge system of the present invention.

With reference to FIG. 4, another embodiment of the instant invention is shown. As illustrated, a laser or light emitting device 52 outputs a laser beam that covers the area that separates upper and lower tools 10, 4 and having a wide enough angle of incidence that the light beam will impinge on an imaging device or a detector 54 on the opposed side of upper and lower tools 10, 4, and worksheet 38. Thus, the portion of the laser beam that is blocked by worksheet would not reach detector 54. Detector 54 is turn is divided into a plurality of areas, the sum of which corresponds to the various locations that a worksheet 38 may be placed with reference to upper and lower tools 10, 4 for bending thereby. Detector 54 may be a CCD camera, or a plurality of light sensitive detector units coupled together to form an image mosaic.

Thus, for the exemplar embodiment shown in FIG. 4, assuming that worksheet 38 blocks light input to the three darkened light sensitive units 55 of detector 54, controller 18 would then be able to correlate those darkened light sensitive units with the actual positioning of worksheet 38, with reference to the plane onto which upper and lower tools 10, 4 lie. Accordingly, if the desired position for worksheet 38 preprogrammed to controller 18 deviates from the sensed actual positioning of worksheet 38, a compensation signal may be sent by controller 18 to the gripper mechanism to further move worksheet 38 until its actual position corresponds to the preprogrammed location that worksheet 38 should be at for that particular bend.

Figure 5:
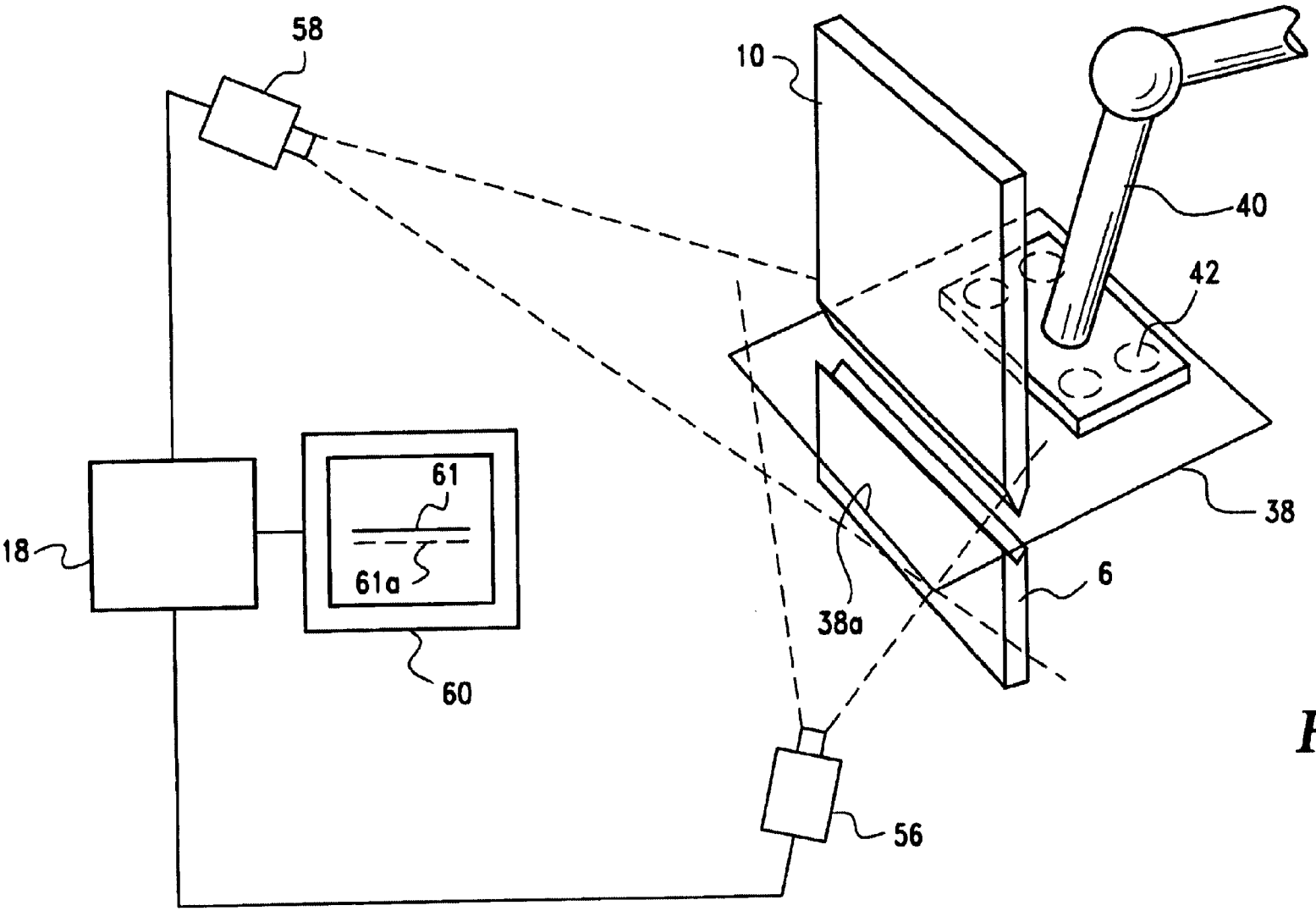
FIG. 5 is yet another embodiment of the present invention system.

Yet another embodiment of the contactless back gauge system for the instant invention is illustrated in FIG. 5. The FIG. 5 embodiment shows the use of two camera each of which takes an image of the portion of worksheet 38 that extends beyond upper and lower tools 10, 6 to the backside of press brake 2. Such imaging camera is made for example by the Metalsoft Company of Santa Ana, Calif. Cameras 56 and 58 are connected to controller 18 and the image that each of those cameras took with respect to worksheet 38 may be displayed on an imager 60. The image 61 as shown in imager 60 taken of the actual positioning of worksheet 38 is compared with an image of the desired positioning of worksheet 38 for that particular bend that has been prestored in controller 18. And by comparing the just taken image with the prestored image, any discrepancy in the positioning of worksheet 38 with respect to the to be desired position of worksheet 38, for example at 61 a represented by the dotted line, can easily be ascertained by controller 18.

Although two cameras are illustrated for the FIG. 5 embodiment, in actual operation, only one camera is needed. Methods in which a position may be calculated from an image are given for example in U.S. Pat. Nos. 5,608,847 and 5,661,671, the disclosures of which being incorporated herein. For the embodiment shown in FIG. 5, to enhance the determination of the positioning of edge 38*a* with reference to upper and lower tools 10, 6, multiple cameras, for example cameras 56 and 58 could be used so that the image displayed on imager 60 would be one that has been correlated from the respective images taken by cameras 56 and 58 for better accuracy. Incidentally, the method as disclosed in the above incorporated by reference U.S. Pat. No. 5,661,671 is also applicable to the embodiment as illustrated in FIG. 3 for determining the location of edge 38*a* of worksheet 38 in relation to the reference plane whereon upper and lower tools 10, 4 lies.

Figure 6:
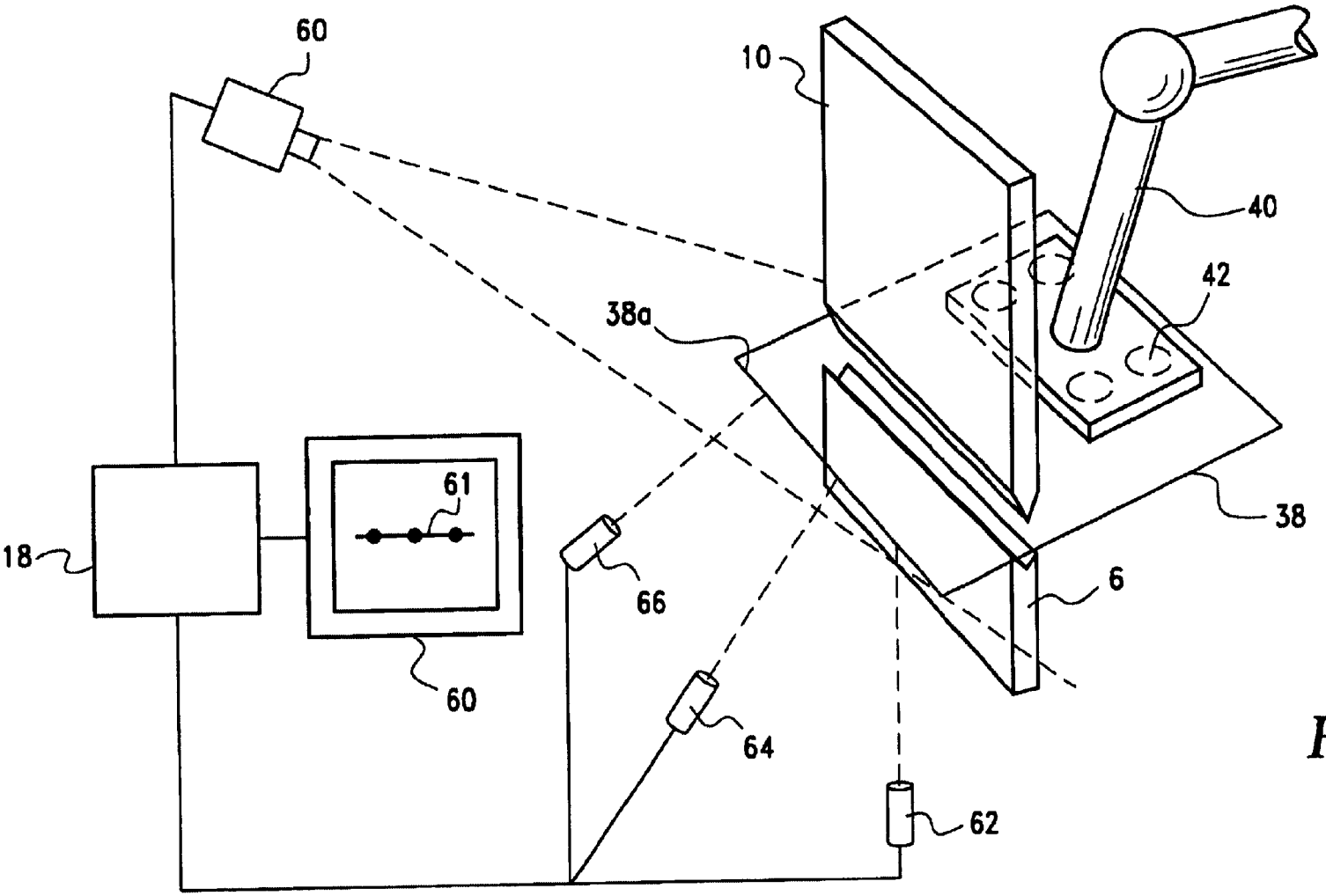
FIG. 6 is yet still another embodiment of the present invention.

Yet another embodiment of the present invention is illustrated in FIG. 6. The laser/camera combination of FIG. 6 utilizes a number of emitters 62, 64, 66 each of which emits a laser beam or light beam that impinges on edge 38*a* of worksheet 38. The impinged light beams, with reference to worksheet edge 38*a*, are picked up by camera 60 and fed to controller 18. By using a triangulation method, such as for example that disclosed in U.S. Pat. No. 5,488,470, the disclosure of which being incorporated by reference herein, a measured image, such as 61 shown on image display 60, is obtained. The measured image is then compared with the desired image that was preprogrammed to controller 18. Any deviation between the two causes controller 18 to output a drive signal to robot arm 40 to further move worksheet 38 to compensate for the discrepancy. Although three light emitters are shown, it should be appreciated that additional light emitters or a minimum of two light emitters may be used for ascertaining the positioning of worksheet 38 with reference to upper and lower tools 6.

Figure 7:
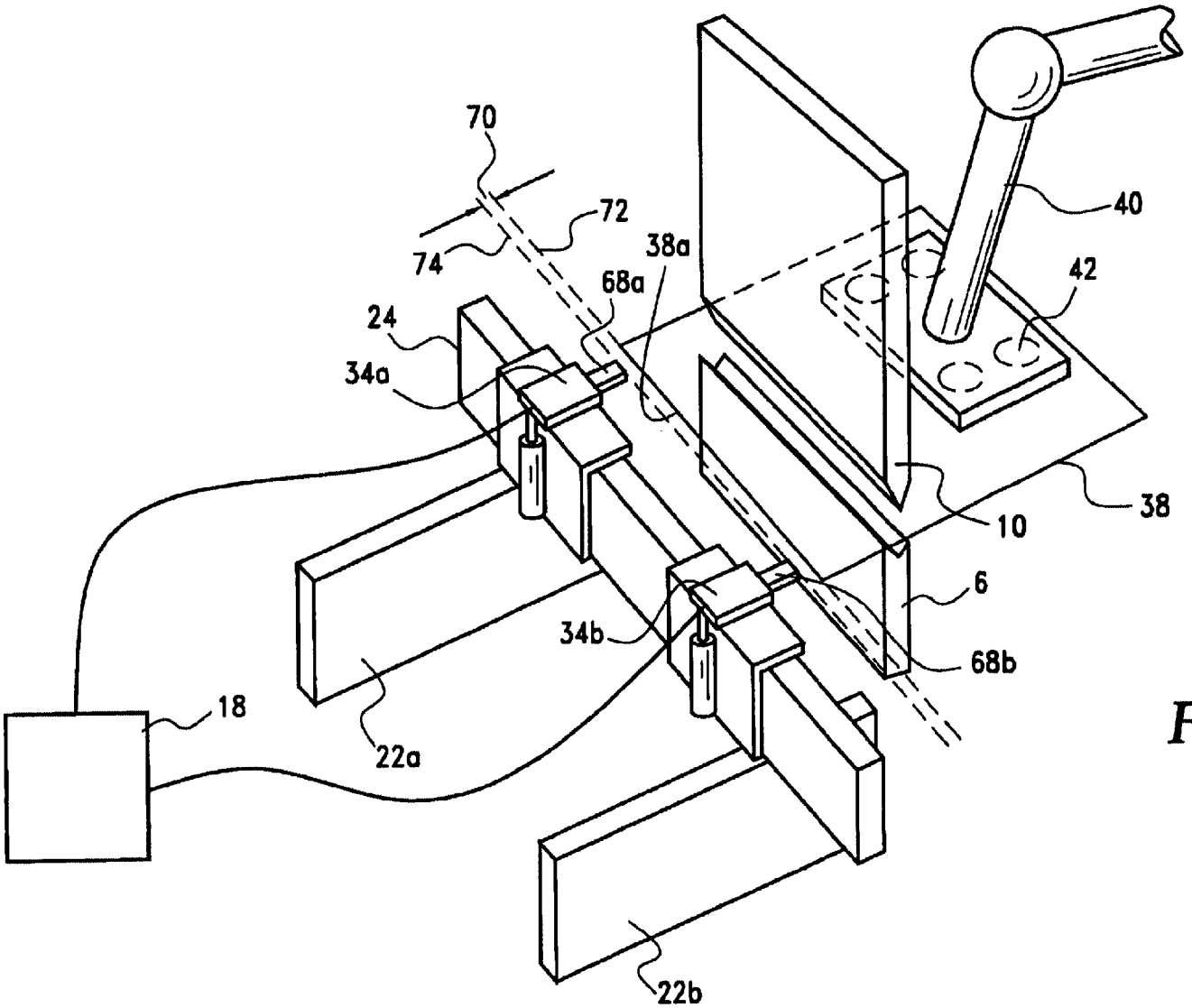
FIG. 7 is a yet a further embodiment of the present invention.

Instead of replacing the back gauge assembly as shown in FIG. 2, for those instances where the user is willing to accept the fact that the various moving systems may need to be replaced due to wear and tear as compared to a completely contactless gauging system, the back gauges 34*a* and 34*b* of the back gauge assembly system as shown in FIG. 2 may be retrofitted with sensors 68*a* and 68*b* as shown in FIG. 7. Sensors 68*a* and 68*b* may be ultrasonic distance measuring sensors such as for example those sold by the Sonin Inc. of Brewster, N.Y. Those ultrasonic sensors will measure anything from a distance of 1" to approximately 60'. By reconfiguring the sensors, which could be done readily, to sense the approach of edge 38*a* of worksheet 38 at for example the distance 70 separated by the two dotted lines, sensors 68 could readily sense the location of edge 38*a* well before it makes contact therewith. By programming the movement of carriage 24 and making sure that there continues to be a distance 70 separating edge 38*a* from sensors 68, sensors 68 will not come into contact with worksheet 38. Accordingly, worksheet 38 could be moved at the same speed in the latter stage of its placement as its earlier stage. So too, if carriage 24 needs to be moved back because edge 38*a* of worksheet 38 has moved beyond reference line 72, then controller 18 would know that there indeed is a discrepancy in the actual positioning of worksheet 38, so that a corrective signal may be sent to gripper mechanism 40 to readjust the positioning of worksheet 38 until sensors 68 once more are able to be repositioned at reference line 74.

In place of the Sonin distance sensors, laser distance sensors such as the infrared distance measurement sensors sold by the Leica Geosystems of Munich, Germany may also be used. Note that although the devices sold by Leica Geosystems are handheld devices, the inside of such devices could easily be removed and modified so as to enable them to be mounted to back gauges 34 of the embodiment shown in FIG. 7.

Figure 8:
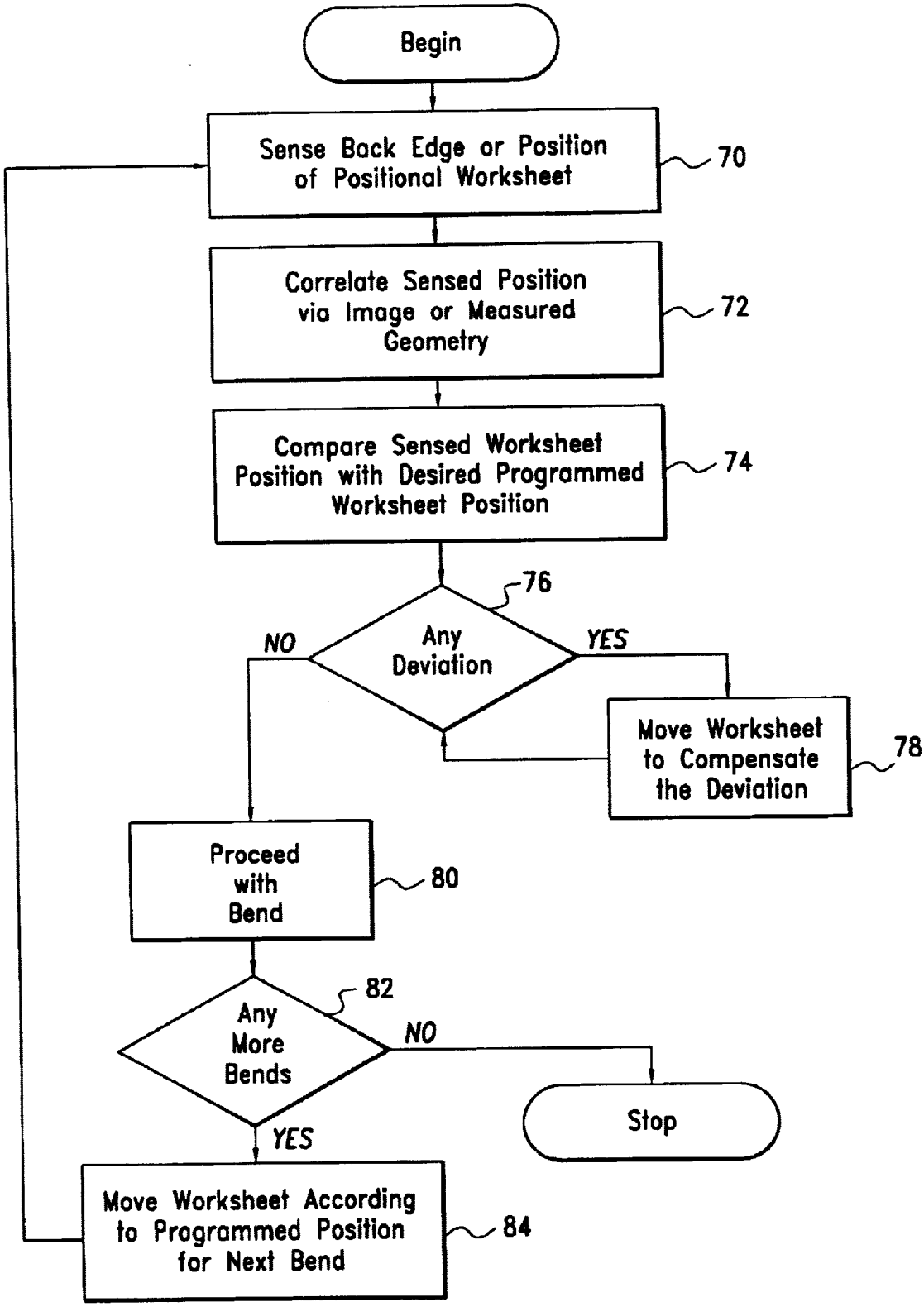
FIG. 8 is a flow chart illustration of the operation of the present invention system.

FIG. 8 is a flow chart that describes the overall operation of the contactless system of the instant invention, as used with each of the embodiments as described.

To begin, worksheet 38, and more specifically the back edge 38*a* thereof, is sensed in step 70. Thereafter, the sensed position is correlated with the image or the measured geometry, per shown in the various embodiments, per step 72. Once the actual position of the worksheet is determined, this actual position is compared with the desired position for the particular bend of the worksheet as preprogrammed into controller 18, per step 74. The operation then proceeds to determine whether there is any deviation between the actual position of worksheet 38 and its desired position, per step 76. If there is deviation between the actual and desired position of the worksheet, then a signal is provided by controller 18 to further move the worksheet so as to compensate for the detected deviation, per step 78. Thereafter, additional determination is made per step 76 for ascertaining whether any deviation remains. If there is no more deviation, then the operation proceeds with the bending of the worksheet at that location, per step 18. The process next proceeds to determine whether additional bends are to be made on the part, or the worksheet, per step 82. If there is no more bend to be made, the process stops. If there is, the worksheet is further moved in accordance with the next programmed position for the next bend, per step 84. Thereafter, once the worksheet is placed between the opening resulting from the separation of upper and lower tools 10, 6, the back edge 38*a* of worksheet 38 is once more sensed per step 70. The whole process continues until no more bend is to be made with the particular part or worksheet.

Inasmuch as the present invention is subject to many variations, modifications and changes in detail, it is intended that all matter described throughout this specification and shown in the accompanying drawings be interpretative as illustrative only and not in a limiting sense. Accordingly, it is intended that the invention be limited only by the spirit and scope of the hereto appended claims.

What is claimed is:

1. Apparatus for bending a worksheet, comprising:

one tool;

an other tool working cooperatively with said one tool for bending a worksheet placed between said one and other tools;

control means for controlling the relative movement of said one and other tools to bend said worksheet placed therebetween; and sensor means positioned proximate to said one and other tools for non-contactedly detecting the position of said worksheet relative to a predetermined position to which said worksheet should be moved as said worksheet is placed between said one and other tools;

wherein said sensor means outputs a signal to said control means to provide thereto a feedback of the placement of said worksheet.

2. Apparatus of claim 1, further comprising:

means for holding and moving said worksheet into position between said one and other tools for bending when said one and other tools are separated from each other.

3. Apparatus of claim 1, wherein said sensor means comprises a laser system; and wherein said signal establishes an actual placement of said worksheet referenced by said laser system so that said control means can compare the accuracy of the placement of said worksheet with the desired programmed placement of said worksheet to determine if there is any placement difference that needs to be compensated.

4. Apparatus of claim 1, wherein said sensor means comprises an optical imaging system.

5. Apparatus of claim 4, wherein said control means comprises a computerized numerical controller; and wherein said signal is representative of said worksheet at a given location within an image obtained by said imaging system, said signal being used by said controller to accurately position said worksheet with reference to the image for bending by said one and other tools.

6. Apparatus of claim 1, wherein said sensor means is positioned fixedly relative to said one and other tools.

7. Apparatus of claim 1, wherein said sensor means is movable relative to said one and other tools and detects the position of an edge of said worksheet without making actual contact therewith.

8. Apparatus of claim 7, wherein said sensor means comprises at least one movable gauge having mounted thereto an optical sensor or imaging means that detects said edge when it gets to within a predetermined distance of said gauge, said gauge and said optical sensor or imaging means not coming into contact with said edge.

9. A sheet bending machine, comprising:

one tool and an other tool movable relative to each other between an open position and a closed position for bending a worksheet placed therebetween;

grip means for holding and moving said worksheet into and out of the space separating said one and other tools when said one and other tools are in said open position;

control means for controlling the respective movements of said one and other tools and said grip means; and sensor means for detecting without making contact with said worksheet the position of at least one edge of said worksheet to determine whether said worksheet is being positioned correctly for bending by said one and other tools.

10. Sheet bending machine of claim 9, wherein said sensor means comprises a laser system that establishes the placement of said worksheet by said grip means so that said control means can determine the accuracy of the placement of said worksheet relative to said one and other tools for bending.

11. Sheet bending machine of claim 9, wherein said sensor means comprises an optical imaging system for obtaining an image and the whereabouts of said worksheet in the image so that said control means can determined where to position the to be bent part of said worksheet for bending by said one and other tools.

12. Sheet bending machine of claim 9, wherein said sensor means is positioned fixedly relative to said one and other tools.

13. Sheet bending machine of claim 9, wherein said sensor means is movable relative to said one and other tools and detects the position of the one edge of said worksheet without making actual contact therewith, said sensor means outputting a feedback signal to said control means so that said control means can determine if there is any difference between the actual placement and the desired placement of said worksheet that requires that said worksheet be further moved to compensate for the difference.

14. Sheet bending machine of claim 9, wherein said machine comprises a press brake.

15. In a sheet bending machine having one tool and an other tool working cooperatively with each other to bend a worksheet placed therebetween, and control means for moving said one and other tools relative to each other to bend said worksheet, a method of controlling the positioning of said worksheet for bending comprising the steps of:

a) holding and moving said worksheet into position between said one and other tools for bending when said one and other tools are separated from each other;

b) non-contactedly detecting the position of said worksheet relative to a predetermined position to which said worksheet should be moved as said worksheet is placed between said one and other tools; and c) outputting a signal to said control means to provide thereto a feedback of the position of said worksheet so that said control means can accurately control the positioning of said worksheet for bending by said one and other tools.

16. Method of claim 15, wherein said step a further comprises the step of:

utilizing grip means for holding said worksheet; and wherein said step b further comprises the step of:

detecting without making contact with said worksheet at least one edge of said worksheet being held by said grip means for each bend of said worksheet to determine whether said worksheet is being positioned correctly for said each bend by said one and other tools.

17. Method of claim 15, wherein said step b further comprises the step of:

utilizing a laser system to establish an actual position for said worksheet so that said control means can determine the accuracy of the placement of said worksheet relative to said one and other tools for bending.

18. Method of claim 15, wherein said step b further comprises the step of:

utilizing an optical imaging system to obtain an image showing the whereabouts of said worksheet relative to said one and other tools so that said control means can determined where to position the to be bent part of said worksheet for bending by said one and other tools.

19. Method of claim 15, wherein said step b further comprises the steps of:

providing at least one gauge movable relative to said one and other tools;

mounting to said gauge optical sensor means to detect at least one edge of said worksheet when it gets to within a predetermined distance of said gauge, said gauge and said optical sensor means not coming into contact with said worksheet.

20. Method of claim 15, wherein said step b further comprises the step of:

positioning an optical sensor or imaging means fixedly with respect to said one and other tools for optically detecting the position of said worksheet.

* * * * *